United States Patent [19]

Gray

[11] Patent Number: 4,522,739

[45] Date of Patent: Jun. 11, 1985

[54] ACTIVATED PEROXY COMPOUND BLEACHING COMPOSITIONS AND BLEACHING DETERGENT COMPOSITIONS AND PROCESS OF USING SAME

[75] Inventor: Frederick W. Gray, Summit, N.J.

[73] Assignee: Colgate-Palmolive Company, New York, N.Y.

[21] Appl. No.: 293,573

[22] Filed: Aug. 17, 1981

Related U.S. Application Data

[60] Division of Ser. No. 929,845, Jul. 31, 1978, Pat. No. 4,292,191, which is a continuation-in-part of Ser. No. 629,117, Nov. 5, 1975, Pat. No. 4,107,065.

[51] Int. Cl.[3] ..... C11D 7/18; C11D 7/38; D06L 3/02

[52] U.S. Cl. ..... 252/95; 8/111; 252/99; 252/102; 252/103; 252/186.39; 252/186.4

[58] Field of Search ..... 252/99, 186, 95, 102, 252/103, 186.39, 186.4; 8/111

[56] References Cited

U.S. PATENT DOCUMENTS 3,775,333 11/1973 Loffelman et al. ..... 252/99
4,115,059 9/1978 Blumbergs et al. ..... 252/95 X

*Primary Examiner*—Prince E. Willis
*Attorney, Agent, or Firm*—Herbert S. Sylvester; Murray M. Grill; Norman Blumenkopf

[57] ABSTRACT

An activated peroxy compound bleaching composition includes a peroxy bleaching compound, such as sodium perborate, and an activator for such bleaching compound, which improves the bleaching effect thereof, which activator is a sulfonyl halide, such as an alkoxybenzenesulfonyl halide, preferably an ortho- or para-substituted methoxybenzenesulfonyl chloride, such as p-methoxybenzenesulfonyl chloride. Preferably, the peroxy bleaching compound and activator are included in a synthetic organic detergent composition such as one based on anionic and/or nonionic normally solid detergent(s), preferably also with builder salt(s) present, and bleaching is effected during the washing of fabrics or articles made thereof, in wash waters of various temperatures, even in water which is only warm. The bleaching compound and activator may also be included in pre-soak compositions.

14 Claims, No Drawings

ACTIVATED PEROXY COMPOUND BLEACHING COMPOSITIONS AND BLEACHING DETERGENT COMPOSITIONS AND PROCESS OF USING SAME

This is a divisional of application Ser. No. 929,845 filed July 31, 1978, and now U.S. Pat. No. 4,292,191, which is in turn a continuation-in-part of Ser. No. 629,117 filed Nov. 5, 1975 and now U.S. Pat. No. 4,107,065.

This invention relates to activated peroxy compound bleaching compositions. More particularly, it relates to such compositions which contain an activator or a mixture of activators for the peroxy compound to improve the bleaching thereof without making the bleaching compositions so strong and harsh in their bleaching effects that they objectionably alter the colors of dyed fabrics and articles made from them. The compositions of this invention and detergents and pre-soaks including them are useful for bleaching fabrics and removing stains from them, whether the fabrics are white or dyed, and are capable of such stain removal in both hot and cold waters.

It has long been known that peroxides and various peroxy compounds, sometimes referred to as per-compounds, are capable of bleaching fabrics to remove objectionable stains from them. Among the most commonly employed materials for this purpose is sodium perborate, usually in the form of its tetrahydrate, although sodium percarbonate, various other percompounds, usually as salts, preferably sodium salts, and different alkali metal and other analogues of the sodium salts have also been found useful. These compounds release active oxygen which, either of itself or by forming a desirable oxidizing intermediate compound, oxidizes the stain and converts it to a colorless material or to another product which is more readily removable from the fabric substrate. Sodium perborate tetrahydrate, $NaBO_2.H_2O_2.3H_2O$, contains about 10% of active oxygen and therefore about one gram of sodium perborate in a liter of water yields about 100 parts per million of active oxygen. [In this application when sodium perborate is referred to without qualification the usual commercial form of the perborate, the tetrahydrate, is intended but equivalent proportions of other hydrates, e.g., sodium perborate trihydrate, and the anhydrous form may also be employed]. The normal percarbonate of commerce, $2Na_2CO_3.3H_2O_2$, usually contains about 12 to 14% of active oxygen. It and other peroxy compounds, such as sodium peroxypyrophosphate and sodium peroxysilicate, which may be utilized in place of some or all of the mentioned peroxy or percompounds, will be employed in weights sufficient to produce equivalent proportions of active oxygen when they are substituted for the perborate or percarbonate. This also applies with respect to other compounds of the types named, such as different hydrates and different salts, which may be substituted for the other hydrates and salts on an equivalent active oxygen or hydrogen peroxide production basis. Thus, in this specification and in the claims the proportion of peroxy compound employed will usually be given with respect to the weight of active oxygen obtainable therefrom.

In Europe bleaching detergents usually include sodium perborate and the washing and bleaching of laundry are effected by bringing the aqueous laundering medium to a boil or near boil, for example, to temperatures of 85° to 100° C., preferably 90° to 99° C., at which temperatures the perborate is made much more active and much more efficient in bleaching action. Such bringing to the boil may be effected quickly but is usually gradual, with some washing at low temperatures initially to remove low temperature water-soluble stains and soils without fixing certain such stains onto the fabrics by immediate subjection to high temperatures. In the United States and in many other countries laundry is not normally boiled. In fact, often home laundry machines operate at a temperature of 60° C. or less, sometimes as low as 25° C. Also, many modern synthetic polymeric fabric materials that are treated with permanent press or wrinkle resistant finishes should not be heated to high temperatures during washing and bleaching operations because such finishes tend to deteriorate and/or discolor in aqueous media at such elevated temperatures. Many dyestuffs are altered or too readily removed from fabric substrates by aqueous media at high temperatures and such temperatures can cause shrinking or other distortions of the substrates. Furthermore, for energy conservation reasons, it has frequently been suggested that the use of high water temperatures should be avoided. Therefore, it is especially desirable to employ cold or warm water in washing, rather than hot or boiling water. In fact, European washing machine design is presently undergoing change in an effort to conserve energy by employing lower temperature wash water in the laundry.

The bleaching art has recognized that certain compounds are useful to activate peroxy compound bleaching of stains and soils from fabrics. It is known that some peroxy bleaches are relatively ineffective at lower temperatures and therefore cannot be employed successfully in low temperature washing processes unless an activator is utilized. Thus, cotton, linen, polyesters, polyester-cotton blends, nylons, acrylics and various other available materials, whether woven or nonwoven, knitted, sewn or otherwise converted to fabric form, can be bleached with an activated peroxy compound bleaching composition, even at relatively low temperatures, due to the presence of the activator and its increasing the activity of the peroxy compound. Among the activators that have recently been employed are included such compounds as 2,4-dimethoxy-6-chloro-s-triazine (DCT); 2-[bis(2-hydroxyethyl-)amino]-4,6-dichloro-s-triazine, (BHADT); diacetyldimethylglyoxime (DDG); and tetraacetylglycoluril (TAGU). Although the mentioned activators are effective in increasing the bleaching effects of sodium perborate and sodium percarbonate, especially in low temperature aqueous media, some of them are so strong in their activating effects that they tend to cause discoloration of dyed materials whereas others are not usually capable of so increasing the activity of the peroxy compound as to make it sufficiently effective in cold or warm water to be competitive with peroxy compound bleaching processes wherein the aqueous medium containing the peroxy compound is boiled or brought near to the boil. Some mixtures of different activators have been found to be highly desirable, as described in my patent application Ser. No. 487,889, filed July 12, 1974, now U.S. Pat. No. 3,982,892, granted Sept. 28, 1976, incorporated by reference (including its disclosure of various peroxy compounds of percompounds and activators) in my grandparent application Ser. No. 629,117, now U.S. Pat. No. 4,107,065 and hereby so incorporated herein. However, such activators and mixtures thereof and the mentioned compounds are comparatively expensive, which limits the extents of their uses.

The activators employed in the present compositions and processes are particularly suited for bleaching stains without being damaging to colors of dyed fabrics, are readily made from available materials and are comparatively inexpensive. The preferred activators are in desirable physical form (solid), satisfactorily stable when aged in pre-soak and detergent bleach compositions, especially when the activators are coated, satisfactorily effective in activation and useful with other activators.

In accordance with the present invention an activated peroxy compound bleaching composition comprises a peroxy bleaching compound and an activator for such peroxy bleaching compound which contains a sulfonyl halide such as an aromatic sulfonyl halide (although aliphatic sulfonyl halides, e.g., higher alkyl sulfonyl halides, may also be used). A particularly preferred peroxy compound is sodium perborate tetrahydrate and a particularly preferred activator is p-methoxybenzenesulfonyl chloride. The invention also relates to pre-soak and detergent compositions containing the peroxy bleaching compound and the activator (mixtures of either or both component types may also be used) and processes of bleaching, pre-soaking and washing with such compositions. Thus, the bleaching composition may be used as such but is often preferably included as part of a detergent or pre-soak composition so that the bleaching is obtained during washing or soaking of the fabric (or both). The pre-soak and detergent may be intended for hot or cold water use but for energy conservation, dye integrity and maintenance of dimensions of the fabric articles treated, cold water soaking and washing (and/or cool or warm water soaking and washing) are often preferable.

The closest prior art known to the present inventor, other than the parent patent previously mentioned, is Japanese patent disclosure No. 90,980/73 of Sugano et al. wherein various aromatic sulfonyl halides are added to an aqueous medium concurrently with per-compound to increase bleaching activity. Additional relevant prior art is that cited by the Examiner in the prosecution of the parent patent.

The peroxy bleaching compounds of this invention are usually inorganic materials, preferably salts, such as metal salts, more preferably alkali metal salts and most preferably the sodium (or potassium) salts of inorganic per-acids of which sodium perborate and sodium percarbonate are most preferable, but other organic per-compounds may also be utilized in suitable circumstances, e.g., urea peroxide. In addition to the perborates and percarbonates other peroxy compounds and per-compounds, especially alkali metal salts thereof, may also be employed, at least in part, e.g., 10 to 50% of peroxy compound content, under suitable conditions, such as sodium peroxypyrophosphate, sodium peroxysilicate and sodium peroxide. In general, the preferred per-compounds to be activated are those which may be considered as containing hydrogen peroxide within their structures. These will be employed in amounts equivalent (on an active oxygen basis) to the amounts of sodium perborate tetrahydrate and sodium percarbonate recited herein or may supplement the perborate and/or percarbonate to result in such equivalent amounts of active oxygen. While many of the peroxy compounds utilized will be in the forms of their hydrates, anhydrous compounds may also be utilized and in either case, the amount employed will be such as to provide an equivalent amount of active oxygen, compared to sodium perborate tetrahydrate or sodium percarbonate amounts mentioned.

The activators utilized in the practice of this invention are sulfonyl halides or contain such halides, such as those of the aromatic sulfonyl halide type i.e. of the formula $ArSO_2X$ wherein Ar is an aromatic group and X is a halide such as chloride, bromide or fluoride. While the aromatic group is preferably benzene or substituted benzene one may also utilize other aromatic moieties, including substituted and unsubstituted naphthyl, phenanthryl, anthracenyl and other polynuclear moieties, and in some cases heterocyclics such as furan, thiophene and pyridine may be employed. Also, in suitable circumstances aliphatic moieties such as alkyls of 10 or 12 to 20 carbon atoms, preferably of straight chain structure, e.g., dodecyl, palmityl, may be present. The substituents on the ring compounds may be of various types so long as they are non-interfering with the desired function of the product. Thus, with respect to the benzene derivatives, in addition to the sulfonyl halide substitution, there may be five other nuclear substituents. Normally, however, it is preferred that no more than two other positions on the benzene ring should be substituted and most preferably only one hydrogen of the benzene is substituted, preferably para to the sulfonyl halide. Representative substituents are alkoxy, usually of 1 to 20 carbon atoms, either straight chain or branched but preferably straight chain, halogen, nitro, alkyl, carboxyl, hydroxy, sulfo, acyl and acyl ester, in all of which the carbon content, when possible, is of 1 to 20 carbon atoms. Lower carbon content substituents, of one to six, preferably one to three carbon atoms are most frequently employed but the higher substituents, of 8, 10 or 12 to 20 carbon atoms, may in some cases be preferred. The alkyls of the alkyl, alkoxy, acylamino and other groups are preferably non-substituted but substituents, especially those of the types herein described, e.g., halogen, hydroxy, alkoxy and nitro, may also be present on them.

The halogen of the substituent and the halogen of the sulfonyl halide are preferably the same but may be different. Most preferably the halogen is chlorine but bromine is also very useful. The use of fluorine as a substituent on the aromatic ring, on an aliphatic substituent or as the halogen of the sulfonyl halide group may sometimes be desirable but iodine is usually avoided although it may be operative.

In all the aromatic activators described for best results there is often present at least one alkoxy group of the type described, often most preferably a lower alkoxy, e.g., methoxy, but alkoxies of one to six, preferably one to three carbon atoms, also preferably straight chain, may be used instead. (If a single alkoxy is present it is preferably located para to the sulfonyl group on a benzene ring but may also be ortho or meta. If two are present (or one plus another substituent) these are preferably ortho, para or ortho, ortho, but meta locations are also operative.

In addition to their bleach promotion ability an added advantage of the present activator compounds is found in their production concomitantly of desirable surface active compounds during use. Thus, for example, p-alkoxybenzenesulfonyl chlorides may be converted by the peroxy compound to the corresponding p-alkoxybenzene persulfonic acids which, by release of oxygen and neutralization, produce p-alkoxybenzenesulfonates such as sodium p-methoxybenzene sulfonate or multiple carbon alkoxybenzene sulfonates such as sodium p-hexadecyloxybenzene sulfonate. Compounds such as these and derivatives of various others of the activators, such as those of alkyl substituted nuclei, are possessed of surface activity and/or detergency characteristics and are useful in diminishing the surface tensions of aqueous solutions to thereby improve bleaching, washing and soaking effects and to help remove stains and soil fabrics or articles made from them which are in aqueous media containing such surface active compounds. In additional embodiments of the invention the substituents on the aromatic ring may include other higher alkoxy groups, such as linear dodecyloxy, linear tridecyloxy, linear tetradecyloxy, linear octadecyloxy, corresponding alkyls, stearoylamino and palmitoylamino and such substituents are especially useful in making detersive products when the aromatic moiety is benzene and the sulfonyl halide halogen is chlorine (although bromine often functions about as well). The higher alkoxides and alkyls of the various substituents will normally be of 14 to 20 carbon atoms, preferably 16 to 18 carbon atoms, for good detersive effects. The middle alkoxy and alkyl substituents, those of 7 to 11 carbon atoms, may also be used and produce "mixed" surface active-detergent effects, while the lower substituents, of 1 to 6 carbon atoms, result in surface active derivatives.

Although various pH's may be employed for particular bleaching compositions within this invention, sometimes being as low as 6 or 7, normally the pH will be in the range of 8 to 12, preferably 8.5 to 10.5 and most preferably about 9 to 10 At the alkaline pH's effective bleaching is obtained and sensitive dyed fabrics show less damage from the bleaching compositions than at acidic pH's. Thus, it will often be desirable to employ alkaline reagents such as alkali metal salts, e.g., trisodium phosphate, pentasodium tripolyphosphate, tetrasodium pyrophosphate, tetrapotassium pyrophosphate, sodium carbonate, sodium silicate, borax, alkalies (e.g., hydroxides) and buffers, to adjust the pH of the aqueous bleaching medium. These may be added to the medium separately but much more preferably are included with the bleaching compositions, which are normally in particulate, powdered or bead form. Such may be dispensed as powder or granular products in bulk, in water soluble packets or capsules or as compressed tablets. In built detergent compositions including the present activated peroxy bleaching compounds the builder salt may serve to adjust the pH to the desirable range. Proportions of alkaline salts similar to those in such built detergents may be employed to adjust the pH in bleaching compositions (without detergents) and in pre-soak products. The alkaline builder salts have been tested separately with the perborate and activators and it has been found that they aid in removal of various test stains, with some being better for particular stains. Therefore, a mixture of alkaline builder salts, e.g., sodium carbonate plus sodium silicate, may be preferred, but other salts such as pentasodium tripolyphosphate, tetrasodium pyrophosphate, tetrapotassium tripolyphosphate, borax, sodium bicarbonate, in various mixtures thereof may also be employed.

In the present bleaching compositions the ratio (by weight) of peroxy (including per-salt) bleaching compound or mixture of such compounds to activator or mixture of such activators for such compound(s) is such that the ratio of active oxygen from the peroxy bleaching compound to the activator is in the range of about 1:20 to 1:1, preferably 1:15 to 1:2, more preferably 1:10 to 1:3, and most preferably is about 1:7. Because the proportion of active oxygen in sodium perborate (as the tetrahydrate) is about 10% the ratio of sodium perborate to activator is in the range of about 1:2 to 10:1, preferably 2:3 to 5:1, more preferably 1:1 to 10:3 and most preferably is about 10:7. However, ratios greater than 10:7, such as those in the range of 2:1 to 4:1, may sometimes be most preferable for bleaching in the presence of colored fabrics, especially if an activator which might also be somewhat harsh on dyes is being employed (such as a non-aromatic sulfonyl halide activator being utilized as an additional activator in the bleach). Among supplementary activators may be the aliphatic sulfonyl halides, such as an alkyl or alkoxy sulfonyl halide of 1 to 20 carbon atoms, e.g., dodecyl or dodecyloxy sulfonyl halide. The higher alkoxy or alkyl aromatic sulfonyl halides, e.g., linear octadecyloxybenzene sulfonyl chloride and such long chain compounds have the advantage previously mentioned for higher alkoxy, alkyl or aliphatic chain substituted sulfonyl halides in that they are converted during the bleaching process to useful detergents. When replacing peroxy bleaches and activators either in whole or in part, it is generally considered desirable to utilize corresponding molar proportions of the replacement compounds rather than to use the same weights as were previously employed. The replacement weights can be readily computed from the proportions of active oxygen in the per-compounds and the molecular weights of the original and replacement compounds.

In use, the concentration of bleaching composition described above, which contains only peroxy compound and activator, in the aqueous medium (normally only water) employed to form a bleaching solution, is usually from 0.01 to 0.2%, preferably from about 0.02 to 0.1%. When the bleaching composition is part of a detergent composition, it will normally be about 4 to 60% thereof, preferably 8 to 40% thereof, more preferably about 10 to 25% thereof and most preferably about 17% thereof. The balance is a normal detergent composition, as described herein. The bleaching detergent concentration in wash water will usually be 0.05 to 1%, preferably being about 0.1 to 0.8%, more preferably about 0.15% in the United States and preferably being about 0.5 to 1.0% and more preferably about 0.8% in European countries wherein washing methods and machines utilize higher concentrations of detergent and lower volumes of wash water. Thus, although about the same amounts of detergents, bleaching materials and activators are often employed in both American and European practice the European concentrations of such materials in aqueous media are in the range of about 3 to 10 times those of the American practice, preferably about 3 to 6 times the American concentrations and the volumes of aqueous medium employed are correspondingly inversely changed.

The bleaching compositions of this invention may be used directly for stain removing and bleaching purposes or, as is often preferable, may be incorporated in the detergent compositions or pre-soak compositions for their bleaching and antimicrobial effects. In the pre-soaks the concentrations of bleaching composition may be about the same as those in the bleaching detergent compositions described, the balance of the pre-soak product may be a filler, such as sodium sulfate or a builder salt, such as any of those previously described, and there may be present a surface active agent or detergent in small quantity, e.g., 1 to 4%. The present bleaching compositions may also be utilized in fabric softening preparations, commercial bleaching compositions for bleaching raw fabrics, woodpulp and hair, stain removing products, bleaching scouring cleaners, denture cleaners and sterilizing or antimicrobial compositions. However, of these applications, it is preferable to utilize the activated peroxy compound bleaching compositions in detergent products, with pre-soak and bleaching use also being of greater importance than the other applications mentioned.

The following description of components of bleaching detergent compositions is also applicable to pre-soak preparations and other relevant products, including the present bleaching compositions.

The bleaching detergent compositions of this invention usually include a synthetic organic surface active agent, preferably one having detersive properties, which is normally referred to as a synthetic organic detergent. For the purpose of this specification higher fatty acid soaps will be considered as included within the class of anionic synthetic organic detergents. The anionic detergents will normally have from 8 to 26, preferably from 12 to 22 carbon atoms per molecule and usually will include an aliphatic (preferably alkyl) chain containing about 8 to 18 carbon atoms, preferably from 10 to 16 carbon atoms in a straight chain alkyl group. The most preferred of such detergents are the alkali metal higher alkyl benzene sulfonates, such as the sodium and potassium salts, in which the higher alkyl groups are of 10 to 18 carbon atoms, preferably 12 to 15 carbon atoms and linear. Other such anionic detergents include the alpha-olefin sulfonates, paraffin sulfonates, ethoxylated alcohol sulfates, alkyl sulfates and sulfated higher alkyl phenyl polyoxyethylene ethanols, all preferably as alkali metal salts, such as the sodium salts. A list of useful detergents is found in my U.S. Pat. No. 3,637,339, incorporated herein by reference.

Nonionic detergent compounds may also be employed, often in admixture with an anionic detergent. Such compounds will normally be lower alkylene oxide condensation products, such as polyethylene oxides, which may sometimes have polypropylene oxides present but to such a limited extent that the product is still water soluble. Preferred examples of such materials are the higher fatty alcohol-polyethylene oxide condensates wherein the higher fatty alcohol is of 10 to 18 carbon atoms, preferably 12 to 15 carbon atoms, and the ethylene oxide portion thereof is a chain of 6 to 30 ethylene oxide units, preferably 7 to 15 ethylene oxide units and more preferably about 10 to 15 ethylene oxide units. Also useful are similar ethylene oxide condensates of phenols, such as those of nonyl phenol or isooctyl phenol or other $C_{7-18}$ alkyl phenols.

In addition to the anionic and nonionic detergent compounds, both of which are preferred constituents of bleaching detergent compositions containing the present activated bleaching compositions, there may also be employed amphoteric and cationic detergents. The amphoteric detergents are those containing both anionic and cationic solubilizing groups and a hydrophobic organic group, which is advantageously a higher aliphatic radical containing about 10 to 20 carbon atoms. Examples of such products include the N-alkyl beta-amino-lower alkanoic acids, the N,N-di-lower alkylglycines, the fatty imidazolines and the betaines. The cationic detergents are usually those which contain one or two higher molecular weight substituents and two or three lower molecular weight substituents on a positively charged ammonium nucleus which also has a halide or equivalent ion with it, preferably a chloride or bromide. The higher weight or long chain substituents are usually of 12 to 18 carbon atoms (but benzyl may be used instead) and preferably are lauryl, myristyl or stearyl, with stearyl being most preferred. The lower weight short chain substituents are preferably lower alkyl, such as alkyl of 1 to 3 carbon atoms, e.g., methyl. Exemplary of the cationic detergents are distearyldimethyl ammonium chloride, cetyltrimethyl ammonium bromide, benzyldimethylstearyl ammonium chloride and dimethylpropylmyristyl ammonium chloride and the corresponding bromides or chlorides.

Although non-built detergent compositions intended for light duty uses, such as dishwashing, sterilization, fabric softening and cleaning of delicate materials, may be made without builder salts, normally such salts are incorporated in pre-soak compositions, heavy duty detergent products, denture cleansers and scouring powders. The most preferable of the builder salts are the alkali metal salts, preferably the sodium and potassium salts of inorganic acids, e.g., pentasodium tripolyphosphate, tetrasodium pyrophosphate, sodium silicates, preferably of $Na_2O:SiO_2$ ratio of 1:1.6 to 1:2.6, sodium carbonate, potassium bicarbonate and borax. Zeolite molecular sieves such as those described in U.S. patent application Ser. No. 467,688 of Bao-Ding Cheng for Detergent Composition, filed May 7, 1974, and in the references described therein, hereby incorporated by reference, may be used in replacement of some or all of such builder salts. Inorganic builders are preferred but organic builders are also useful, e.g., trisodium nitrilotriacetate, sodium citrate, potassium gluconate and hydroxyethyl iminodiacetate, disodium salt. With the builder salts there may sometimes be employed filler salts, such as alkali metal halides and sulfates, e.g., sodium chloride, sodium sulfate.

In the detergent compositions there may also be present enzymes for assisting in breaking down the molecular structures of various stains and thereby helping to remove them from the substrates to which they are attached. Such enzymes are usually proteolytic enzymes, e.g., protease (sold under the trademark Alcalase) but also useful are amylotic and other enzymes, e.g., amylase. Various other components may be present in the detergent compositions, including soil suspending agents, anti-redeposition agents, hydrotropes, wetting agents, flow-improving agents, sequestrants, bactericides, fluorescent brighteners, stabilizers, fillers, coating agents, fungicides, emollients, perfumes, colorants and solvents. Also, various components of the compositions may be coated or encapsulated to prevent interaction thereof with other composition ingredients. Thus, for example, the activators and/or peroxy bleach materials may be coated, plural coated or encapsulated with water-dispersible polyethylene glycol solids (Carbowax ®), polyvinyl alcohol, paraffinic waxes, vegetable waxes, monoglycerides and other suitable protective coverings. Furthermore, the protective coatings for the activators and/or peroxy bleach materials may include dextrin, dextrin containing a dispersing aid such as sodium lauryl sulfate, plasticized dextrin, carboxymethyl starch, sodium carboxymethyl cellulose, potato flour or other suitable materials, as described in Netherlands patent application No. 73/07820, filed by Henkel & Cie., GmbH on June 5, 1973, and Swedish patent application No. 72/005711, filed by Unilever N.V. on Apr. 28, 1972, both of which are incorporated herein by reference. The coatings may be applied by pan mixing, spraying, solvent application and various other means known to the art and by methods described in the aforementioned applications. Coating thicknesses will usually be from 0.05 to 1 mm., preferably 0.1 to 0.5 mm., e.g., 0.2 mm., and preferably the coatings will be applied to the activators.

More extended descriptions of the various ingredients of the present detergent compositions and other preparations including the activated bleach compositions of this invention are found in my U.S. Pat. Nos. 3,637,339; 3,640,874; 3,655,567; and 3,714,050, the disclosures of which are incorporated herein by reference. Also included by reference are the specific disclosures of the various synthetic organic detergents described in those patents plus the enzymes, adjuvants, bleaches and activators, and the proportions and conditions under which such materials are employed, together with methods for manufacturing them and components thereof.

Additional descriptions of detergents that are useful and accompanying builders, adjuvants, etc., are described in the texts *Surface Active Agents and Detergents,* Vol. II, by Schwartz, Perry and Berch, published in 1958 by Interscience Publishers, Inc., especially at pages 25–138, and in *Detergents and Emulsifiers,* 1969–1973 *Annuals,* by John W. McCutcheon.

The proportions of activated bleach composition in the bleaching detergent compositions of this invention will normally be from 4 to 60% thereof, with the peroxy compound or mixture thereof being from 3 to 40 or 59% and the activator or mixture thereof being from 1 to 25 or 57%. Preferably such bleach composition content in the detergent product is from 7 to 40% thereof, more preferably from 10 to 25% thereof and most preferably about 17% thereof, while the peroxy compound content is preferably from 5 to 30%, more preferably from 5 to 20% and most preferably about 10% (1% active oxygen content, by weight). The preferred, more preferred and most preferred activator content ranges and percentage are 3 to 20%, 5 to 10% and 7%, respectively.

The anionic detergent compound content, preferably in a mixture of anionic and nonionic detergents but sometimes anionic detergent alone, is from about 5 to 30%, preferably 7 to 20%, e.g., 9, 15 and 18% of sodium linear dodecyl or tridecyl benzene sulfonate and the nonionic detergent content (preferably with anionic detergent but sometimes alone) is 0.5 to 10%, preferably 0.5 to 5%, e.g., 1 and 4% of Neodol ®45-11 (condensation product of higher fatty alcohol of 14–15 carbon atoms and ethylene oxide, with 11 epoxy groups per molecule).

The builder salt content is usually in the range of 10 to 60% or 70%, preferably being 15 to 55%, e.g., 32% of pentasodium tripolyphosphate and 7% of sodium silicate of $Na_2O:SiO_2$ ratio of 1:2.4, or 21% of such silicate alone. More preferably, the builder salt content is in the range of about 17 to 45%. Inorganic filter salt content will usually be from 5 to 50%, preferably from 10 to 45% and more preferably from 20 to 45%. In most cases the inorganic filler salt will be sodium sulfate, anhydrous. In non-phosphate formulas the percentages of anionic detergent (including the normal alkali metal higher fatty acid soaps, preferably the sodium soaps of mixtures of hydrogenated tallow and hydrogenated coconut oil) will preferably be increased (often by 1/10 to ½) over those present in phosphate-containing detergent compositions and sodium silicate ($Na_2O:SiO_2$ ratio of about 1:2 to 1:2.6 or 1:3) will be employed (generally of $Na_2O:SiO_2$ ratio in the range of 1:2.3 to 1:2.5).

The percentages of the various adjuvants that are utilized will usually be from 0.01 to 5% of each, with the total thereof being from 1 to 10%. Thus, the percentage of soil suspending agent, such as sodium carboxymethyl cellulose, may be from 0.3 to 2% and the percentage of flow improving agent (calcium magnesium silicate) may be from 0.2 to 2%, while that of fluorescent brighteners or dyes may range from 0.01 to 2%, depending on the particular compounds utilized. The various proportions given for the detergent composition apply when the peroxy compound content is such as to yield about 2.5% or less active oxygen by weight. When more than 2.5% of active oxygen is present, such as when the proportion of sodium perborate or equivalent is greater than 25%, the proportions of filler salt and builder salt will usually be decreased accordingly.

The detergent composition, except for the peroxy compound and activator, is preferably produced by conventional spray drying operations and is generally in bead form with particle sizes such that substantially all of the product, over 95%, passes through a No. 8 U.S. Standard Sieve Series sieve and less than 10% of the product and preferably less than 5% thereof passes through a No. 100 sieve. Preferably, the remaining portion of the formula will be similarly sized, either by aggregation of particles or coating thereof with protective materials but it may also be in finely divided powder form, such as will pass through a No. 100 sieve and rest on a No. 325 sieve, in which case the powder may also adhere to the larger spray dried detergent particles. The coated particles mentioned will usually contain from 5 to 75% of coating materials, preferably about 30 to 60% and normally about 50%, which may be at least partially replaced by an aggregating material such as a gum, adhesive or crystal-forming salt. The moisture contents of the spray dried detergent beads or other form of detergent particles employed will normally be from 1 to 15% or 20%, most usually about 3 to 12%. The moisture content of the peroxy compound and the activator therefor will preferably be limited to the water of crystallization contained therein, with a permissible excess that is rarely over 3%, and preferably, with no excess. It is sometimes preferred to limit the moisture content of the product by minimizing detergent bead moisture, holding it to about 1 to 6%, and using substantially anhydrous bleach and activator, e.g., of 0 to 3% moisture contents, to promote storage stability.

In the use of the bleaching composition as a sterilizing medium or a denture cleanser the proportion of synthetic organic detergent may be diminished to as little as 1% or it may be omitted entirely and the various adjuvants may also be omitted from the formula. To make a scouring powder the detergent formula may be employed but with from 80 to 95% of the total formula being a scouring powder material, such as finely divided silica (silex). In denture cleansers and sterilizers the proportion of bleaching composition present may be increased, sometimes to two to four times the proportion in the detergent composition. For bleaching applications the concentration of bleaching composition in the aqueous medium employed may be varied over a wide range, usually being up to 1% in such applications.

The present detergent compositions are employed in the same manner as comparable products not containing the bleaching components. Thus, they may be used for cold, warm and hot water washing, usually in a temperature range of 10° to 70° C. Of course, as with all bleaching operations, care should be taken in the selection of materials to be bleached but apart from this general precaution, the present compositions may be employed with safety, giving effective cold and warm water bleaching, even with colored goods, without seriously adversely affecting dye fastness. When employing the bleaching detergents, the washing times need not be changed from ordinary wash cycle times, usually being from 5 minutes to one hour, preferably being from 10 to 30 minutes in the United States and from 20 to 40 minutes according to European practice. Similar or corresponding times may also be employed with respect to other applications of the bleaching compositions, such as those previously mentioned, or the corresponding application times normally utilized for such products may be employed. Thus, for pre-soaks, soaking times of 15 minutes to three hours are usual but soaking may be overnight, too.

The present compositions may be used in waters of various hardnesses, ranging from 0 to over 300 parts per million (as calcium carbonate), usually with the hardness being from a mixture (e.g., 1:4 to 4:1) of dissolved calcium and magnesium salts. Normally the hardness will be from 50 to 150 p.p.m. If the wash water is hard water results are best when a builder salt is present and the detergent composition is of the heavy duty type.

As a result of utilizing the compositions and processes of this invention greatly improved bleaching effects are obtained with activated peroxy bleach compounds without the need to raise any aqueous medium employed to the boiling point. Also, the activated bleaching compositions and materials including them are especially good for removing a wide variety of difficult-to-remove stains from fabrics, including coffee, tea, wine and certain dye stains, or for significantly decreasing their concentrations. Such desirable results are obtained without harming the fabrics and without serious adverse effects on commercial commonly used household dyed fabrics, such as blue dyed cotton or polyester-cotton blends, which have been used as test fabrics to measure bleach safety. The active oxygen-releasing compositions also possess antimicrobial properties.

The invention will be further illustrated by the following examples thereof. Unless otherwise indicated, all parts therein and in the specification are by weight and all temperatures are in °C.

EXAMPLE 1

| | Parts |
|---|---|
| Part I | |
| Sodium linear tridecylbenzene sulfonate | 15.0 |
| Polyethoxylated higher fatty alcohol ($C_{12-15}$ alcohol with 11 mols ethylene oxide) | 1.0 |
| Pentasodium tripolyphosphate | 33.0 |
| Sodium silicate ($SiO_2$:$Na_2O$ = 2.4) | 7.0 |
| Sodium carboxymethyl cellulose | 0.3 |
| Sodium sulfate | 33.7 |
| Water | 10.0 |
| Part II | |
| Sodium perborate tetrahydrate | 12.5 |
| Perborate activator | 8.75 |
| Sodium sulfate, anhydrous | 3.75 |
| | 125.00 |

A detergent composition in particulate bead form is made by spray drying an aqueous slurry containing about 50% solids (the first six components of the Part I formula) in a conventional countercurrent hot air spray drying tower and then sieving the product, which is of the formula of the first seven Part I components listed above, so that over 95% thereof passes through a No. 8 U.S. Standard Sieve Series sieve and less than 5% passes through a No. 100 sieve. The perborate-activator bleach combination, together with the sodium sulfate (the last component listed in the formula above) of Part II is post-added and blended into the detergent composition. Separate components, such as brighteners and enzymes, can be added too, in which case the sulfate may be omitted. In variations of this experiment the peroxy compound and activator particles are coated with a protective coating, such as polyvinyl alcohol, dextrin, CMC or other suitable water soluble gum, "resin" or polymer, and in some cases they are also aggregated to the detergent bead size. The coating is from 30 to 60% of the weight of the resulting coated particles, e.g., 50% of dextrin.

Tests are run at 24° C. and 49° C. (75° and 120° F.), using 0.5% concentration (European concentration) of the bleaching detergent composition in Piscataway, N.J. town water (of a hardness of about 100 p.p.m., as calcium carbonate). The automatic washing machine employed is manufactured by the General Electric Company and includes a mini-basket or water saver feature. The mini-tub is filled with 21 liters of water, 125 grams of detergent composition are added to it and various stained or dyed test fabrics are washed for 15 minutes, with the weight of the test fabrics and terrycloth towels to which they are fastened, being about 0.9 kilogram.

The washing and stain removing properties of the test composition of the above formula are compared to those of a control composition, identical in all respects except that the 8.75 parts of activator are replaced with 8.75 parts of sodium sulfate, anhydrous. It is noted that no optical brighteners are employed in the present tests so that any brightening effects thereof will not interfere with the measurement of stain removal.

Reflectance readings (Rd) for all test swatches are taken before washing with the aid of a Gardner Color Difference Meter and similar readings are taken after the conclusion of washing.

The cloths that have been stained are originally white and therefore ΔRd is indicative of stain removal, with the larger ΔRd readings indicating more stain removal and a greater approach to original whiteness (before staining). For dyed household use fabrics, unless soiled with an objectionable stain, it is desirable for ΔRd to be low, indicating that color has not been removed by bleaching. The recording of Δb readings affords a measure of bleach damage to blue dyed fabrics. Low or negative Δb readings are a sign of good dye safety since they indicate that the cloth is not changing from blue to undesirable yellow.

Swatches employed are of rectangular shape, 8 cm. by 10 cm. and are fastened to 39 cm. by 62 cm. rectangular terrycloth towels. In all cases the test swatches, comprising stained, dyed and clean test fabrics, are attached to the terrycloth towels so as to minimize the possibiity that they may be compacted or trapped in some other item of laundry which would prevent or inhibit effective bleaching and washing during the normal washing cycle.

Excellent washing and stain removal results are obtained with a variety of test fabrics and test stains and dyed fabrics are not overbleached objectionably. When the perborate activator (which is also effective to activate percarbonate and other percompounds) is para-acetaminobenzenesulfonyl chloride (NASC) the pH of the wash water at the end of the wash is 9.7 compared to 9.9 for the control at 24° C. and such pH's are 9.5 and 9.8 respectively for the 49° C. wash tests, all tests being at 0.5% of the detergent composition concentration in the wash water. Stain removal is especially good, compared to the control, for essentially all the stains against which the bleaching detergent composition is tested. Such stains include mixed coffee/tea, EMPA 114 (red wine), EMPA 115 Bleach Test Cloth (Testfabrics, Inc.), tea, coffee, blueberry, cocoa and grape, on cotton and mixed cotton-polyester test swatches. The following table (Table I) compares the percentages of stain removal, based on Rd difference. Thus, for example, if clean cloth prior to staining has an Rd of 90 while that of stained cloth is 66 and after washing Rd for the control is 70 and for the experimental product is 80, the percentages of stain removals would be 17% for the control and 58% for the experimental [(70−66)/(90−66) and (80−66)/(90−66)], respectively.

TABLE I

Percent Stain Removals at 0.5% Detergent Composition Concentration

| | | 24° C. | | 49° C. | |
|---|---|---|---|---|---|
| Stain | Fabrics | Expt'l. | Control | Expt'l. | Control |
| Coffee/Tea | Cotton | 51 | 10 | 59 | 24 |
| EMPA 114 | Cotton | 27 | 14 | 44 | 36 |
| EMPA 115 | Cotton | 14 | 0 | 23 | 2 |
| Tea | Cotton | 49 | 15 | 62 | 30 |
| Tea | Cotton/Dacron | 22 | 4 | 32 | 15 |
| Coffee | Cotton | 56 | 31 | 68 | 46 |
| Coffee | Cotton/Dacron | 59 | 47 | 66 | 58 |
| Blueberry | Cotton | 57 | 32 | 66 | 50 |
| Blueberry | Cotton/Dacron | 38 | 24 | 49 | 33 |
| Cocoa | Cotton | 35 | 30 | 40 | 35 |
| Cocoa | Cotton/Dacron | 42 | 25 | 33 | 17 |
| Grape | Cotton | 62 | 44 | 73 | 61 |
| Grape | Cotton/Dacron | 37 | 28 | 49 | 37 |

The data tabulated above indicate that significant improvements in stain removal are obtained utilizing the described activated perborate bleaching detergent composition. In addition to the stain removal, in other tests wherein dye stability to the present compositions is evaluated, various blue, pink, yellow and green dyes are found to be satisfactorily stable on cotton and cotton/-polyester blends. Also, when tested against various soils for soil removal (rather than stain removal), essentially the same soil removal activity is obtainable as with the control. Similarly, in tests of soil deposition and fluorescent intensity acceptable results, comparable to the control, are obtained. It is noted that the fluorescent intensity is somewhat diminished, apparently due to a partial bleaching effect on optical brighteners or fluorescent dyes employed, but fabrics washed in aqueous solutions of the experimental detergent composition, with fluorescent dyes present, still adsorb or chemically react with sufficient amounts of such dyes to satisfactorily optically brighten the washed materials.

In other tests like those described above except for the use of the full washing machine tub containing 68 liters of wash water, making the concentration of bleaching detergent composition in the wash water 0.15% (American concentration), pH's of the wash waters at the ends of the washes are 9.7 and 9.8 for the experimental and control in the 24° C. test and 9.5 and 9.7 for the experimental and control in the 49° C. test, respectively. Stain removal test results are given in Table II below.

TABLE II

Percent Stain Removals at 0.15% Detergent Composition Concentration

| | | 24° C. | | 49° C. | |
|---|---|---|---|---|---|
| Stain | Fabrics | Expt'l. | Control | Expt'l. | Control |
| Coffee/Tea | Cotton | 18 | −1 | 28 | 3 |
| EMPA 114 | Cotton | 26 | 21 | 42 | 36 |
| EMPA 115 | Cotton | 3 | 0 | 7 | 1 |
| Tea | Cotton | 20 | 4 | 29 | 11 |
| Tea | Cotton/Dacron | 2 | −1 | 5 | −2 |
| Coffee | Cotton | 32 | 20 | 47 | 33 |
| Coffee | Cotton/Dacron | 40 | 32 | 52 | 48 |
| Blueberry | Cotton | 35 | 23 | 45 | 36 |
| Blueberry | Cotton/Dacron | 19 | 13 | 27 | 18 |
| Cocoa | Cotton | 31 | 31 | 32 | 27 |
| Cocoa | Cotton/Dacron | 25 | 18 | 10 | 3 |
| Grape | Cotton | 43 | 34 | 55 | 49 |
| Grape | Cotton/Dacron | 20 | 16 | 27 | 21 |

As with the washings at 0.5% concentration, the washings at 0.15% detergent concentration result in better bleachings of the difficult-to-remove test stains described. Yet, the product is safe on normal dyed fabrics, removes soil well, has good soil anti-redeposition properties and allows the adsorption by the fabric of fluorescent brighteners, e.g., 0.7% of a mixture of a minor proportion of Tinopals RBS and 5BM with a major proportion of stilbene brightener (No. 4) or more preferably, 0.7% of brightener BHC (Phorwite BHC) replacing 0.7% of $Na_2SO_4$, when they are included in the composition (in variations of the described experiments). The experimental compositions are comparable in bleaching activity and are considered essentially equivalent to similar compositions containing TAGU as an activator, which was heretofore considered to be a standard for peroxy compound bleach activators.

In other variations of the above experiments the sodium perborate tetrahydrate is replaced by equivalent (on an active oxygen basis) amounts of sodium percarbonate, sodium peroxypyrophosphate, sodium peroxysilicate and by 50:50 mixtures of sodium percarbonate, sodium peroxypyrophosphate and sodium peroxysilicate with sodium perborate (the differences being made up by modifying the proportions of sodium sulfate present). Instead of the described activator, when other aromatic sulfonyl halides are employed, such as para-toluenesulfonyl chloride, benzenesulfonyl chloride, ortho-nitrobenzenesulfonyl chloride, para-nitrobenzenesulfonyl chloride, para-isopropylbenzenesulfonyl chloride, para-n-dodecylbenzenesulfonyl chloride, para-n-pentadecylbenzenesulfonyl chloride, para-methoxybenzenesulfonyl chloride, para-n-butoxybenzenesulfonyl chloride, para-chlorobenzenesulfonyl chloride, m-benzenedisulfonyl chloride, m-(chlorosulfonyl)benzoic acid and para-n-butanoylaminobenzenesulfonyl chloride and corresponding bromides and fluorides and by 50:50 and other mixtures of the various two-member or higher combinations thereof similar favorable bleaching results are obtainable with respect to the control composition at the 24° C., 49° C. and intermediate temperature operations. This is also the case when other concentrations of the detergent in the wash water within the range of 0.1 to 1% are employed, e.g., 0.1%, 0.3% and 1% and when the temperature ranges from 10° C. to 70° C., e.g., 15° C., 35° C. and 55° C. Also, when the proportions of synthetic organic detergent are varied over the range of 5 to 30%, preferably 7 to 20% of such a composition. that detergent is changed to sodium higher olefin sulfonate, sodium lauryl sulfate, sodium (or potassium) hydrogenated coconut oil fatty acids monoglyceride sulfate, sodium paraffin ($C_{16-18}$) sulfonate or sodium polyethoxy higher fatty ($C_{12-18}$) alcohol sulfate or mixtures thereof and the nonionic is changed to others described in the specification, such as Neodol 45-11, Pluronic F-68, Alfonics 1618-60 or 1618-65 or Tergitols 15-S-7, 15-S-9 or 15-S-12 or other condensation products of polyoxyethylene and a lipophilic moiety or mixture thereof, at concentrations of about 0.5 to 10%, e.g., 2%, 4%, in the detergent, good stain removals result. If desired, a fluorescent brightener or a mixture of such brighteners may also be present. Of course, the proportions of anti-redeposition agent, builder salt, filler salt and various adjuvant materials may be modified and different components within these groups may be employed, as described in the specification, and good stain removal is also obtained.

It is considered that the efficacy of the present aromatic sulfonyl halides as peroxy compound bleach activators is due to the formation of an aromatic persulfonic acid or persulfonic acid salt which acts as the bleaching agent. Of course, such a theoretical reaction, although considered to be correct, is not binding or limiting with respect to the present invention.

In general, the aromatic sulfonyl chlorides are more stable than aliphatic sulfonyl chlorides and are therefore preferred. Those that are not sufficiently stable in the presence of a peroxy compound or in detergent containing a peroxy compound may be coated, as previously described. Para-acetaminobenzenesulfonyl chloride (NASC) in detergent with perborate has been stored for comparatively long periods of time in moisture barrier containers at temperatures up to 43° C. (110° F.) and has thereafter been found still to be an effective bleaching activator, although it is still desirable to coat such activator with coating, as previously described, to increase its storage stability. Such is also the situation with the other compositions previously described in this example and when they are coated with any one of polyvinyl alcohol, dextrin, CMC or other sufficiently inert water soluble gum, resin or polymer usually to the extent of 30 to 60% by weight of the final product, e.g., 50%, storage stabilities thereof for 7 and 14 days at both room temperature and elevated temperatures, e.g., 49° C., are improved.

When in the above principal formulas and in the bleaching detergent and bleach coated products described p-methoxybenzenesulfonyl chloride (MBSC) is substituted for NASC slightly more active bleaching is effected, as is sometimes desirable. The MBSC is a little more damaging to dyes, as might be expected of a better bleach, but is sufficiently safe for commercial use. When the methoxy group is in ortho or meta positions comparable effects are obtainable. Also, when the methoxy is alkoxy of up to 20 carbon atoms good activation of the per-compound bleach is obtained and when the alkoxy is a higher alkoxy, e.g., of 14 or 16 to 18 carbon atoms, the activator is converted to a detergent in use. This is also the case for alkyl benzene sulfonyl chlorides of 13, 14 or 16 to 18 carbon atoms in the alkyl and for alkyl sulfonyl chlorides of the same alkyl. With all of the activators mentioned similar results are obtainable when the sulfonyl bromides are used instead of the sulfonyl chlorides.

EXAMPLE 2

The peroxy compound and activator of Example 1, together with the 3% of sodium sulfate or an equal amount of alkaline agent such as carbonate, silicate or phosphate, as the sodium salts, preferably in equal mixture, present with it, are employed alone as a bleach (e.g., 50% sodium perborate tetrahydrate, 35% of NASC and 15% of sodium sulfate, anhydrous, or alkaline compounds may be used) against the stains described in Example 1. The bleach component concentrations and other conditions are the same as employed in Example 1. Improvements in bleaching effects result, compared to a control in which the NASC is replaced by sodium sulfate. Such results are also obtained when the mentioned activators of Example 1 are substituted for the NASC in the given formula and when 2:1, 1:1 and 1:2 mixtures of such activators are utilized with NASC or with para-toluenesulfonyl chloride. Also, when bleaching is effected without agitation, usually over a longer period of time, e.g., ½ hour, or at a higher concentration, e.g., 0.2% of the bleaching composition in the aqueous bleach medium, good bleaching is obtained. At the higher concentration a lesser bleaching time may be employed, e.g., 2 to 5 minutes. Similar good results are also obtained when the proportion of sodium perborate tetrahydrate (or equivalent peroxy compound) and activator are changed so as to be 1:2, 1:1 and 2:1.

In the bleaching applications described the bleaching of hard-to-remove stains is effective and is significantly better for removing coffee/tea and sulfo dye stains, in cool and warm water, than with the same weights of TAGU substituted for the NASC. Damage to normal dyed fabrics is satisfactorily slight or non-existent.

In a variation of this experiment a scouring cleanser is made comprising 4% of sodium perborate, 2% of NASC, 3% of sodium linear tridecyl benzene sulfonate, 5% of pentasodium tripolyphosphate, 1% of adjuvants and 85% of finely pulverized silica (silex) of scouring cleanser type. The composition is used in the normal way to remove grape, blueberry, coffee and tea stains from sink surfaces and is found to be more effective than similar compositions wherein the NASC is replaced by sodium sulfate. Such improved results are also obtainable utilizing the other described peroxy compounds and aromatic sulfonyl halide activators of Example 1 in place of the perborate and NASC.

In the above-described compositions of this example when MBSC is substituted for NASC slightly better bleaching is obtained. However, to improve storage stability in such formulas the MBSC is coated with powdered polyvinyl alcohol (PVA) to the extent of about 30–60% of final product (50% preferred). Such coating also has a desirable slowing effect on dissolving of the activator in the aqueous medium in which the bleach is used and thus also acts to temper bleaching.

EXAMPLE 3

Two pre-soak bleach compositions are made comprising three parts of sodium linear dodecyl benzene sulfonate, ten parts of sodium perborate tetrahydrate, seven parts of NASC (or MBSC) one part of Alcalase proteolytic enzyme preparation, five parts of water and 74 parts of sodium sulfate. Stained laundry swatches, having been stained with the stains listed in Example 1, are pre-soaked in such pre-soak compositions in 100 p.p.m. hardness (as $CaCO_3$) water at concentrations of 0.5% and 1% for times ranging from ½ hour to two hours and subsequently the stained fabrics are washed with conventional heavy duty laundry detergents and alternatively, with the bleaching detergent of Example 1. Effective pre-soak action and good post-detergent washing stain removals are obtained, compared to controls wherein the pre-soak contains no bleaching materials. Similar results are obtained when the previously mentioned peroxy compounds and aromatic sulfonyl halide activators are utilized in complete or partial, e.g., ½, substitution for the perborate and the mentioned activators.

EXAMPLE 4

A non-phosphate bleaching detergent composition of comparatively low foaming properties is made of the following formula.

| | Parts by Weight |
|---|---|
| Linear dodecylbenzene sulfonate, sodium salt | 16.4 |
| Neodol 45-11 | 0.9 |
| Sodium silicate ($Na_2O:SiO_2$ = 1:2.35) | 19.1 |
| Sodium carboxymethyl cellulose | 0.9 |
| Fluorescent brightener (Tinopal 5BM) | 0.7 |
| Sodium 4:1 tallow:coco soap | 2.7 |
| Dye (Polar Brilliant Blue) | 0.02 |
| Pigment (Ultramarine Blue) | 0.04 |
| Sodium sulfate, anhydrous | 37.3 |
| Moisture | 2.7 |
| Preservative (Iphol) | 0.01 |
| Flow improving clay (Satintone) | 0.9 |
| Perfume | 0.13 |
| Sodium perborate tetrahydrate | 9.1 |
| Per-compound activator | 6.4 |
| $Na_2CO_3$ | 2.7 |
| | 100.00 |

The above formulation, containing no phosphate builder salt, is improved in stain removing properties compared to a control from which the mixture of activator and $Na_2CO_3$ is omitted. The product is made by spray drying the first 13 components, except for half of the nonionic detergent, the flow-improving agent and the perfume, from a 50% aqueous slurry, as described in Example 1 and then spraying onto tumbling detergent beads produced the other half of the nonionic detergent, in liquid form at elevated temperature, and mixing the perfume with it, after which the flow improving agent, sodium perborate tetrahydrate, activator and $Na_2CO_3$ are admixed with it. In the case of the control the activator and sodium carbonate are omitted.

Tests for stain removal are run, using 0.15% concentration of the detergent composition (based on the weight of the experimental product) in 24° C. wash water, as described in Example 1, with and without the use of the mini-basket of the washing machine, and at 0.5% concentration, using the mini-basket. At the 0.15% concentration 21 and 68 liters of wash water are employed and at 0.5% concentration 21 liters are used. The control employed utilizes the same quantities of all components but omits the activator and carbonate. Percentages of stain removal for the experimental and control compositions wherein the activator is NASC are given in Table III.

Included in the wash test were various dyed commercial fabrics. Visually, the colors appeared the same after the washes, with or without activator being present. The instrumental readings (ΔRd and Δb) given in Table IV show the experimental and control compositions wherein the activator is NASC to have little or no damaging effects on colors. Similar results are obtained when MBSC is the activator but bleaching is somewhat improved and color safety is slightly less, although acceptable.

TABLE III

| | | Percent Stain Removals (24° C. Wash Water) | | | | | |
|---|---|---|---|---|---|---|---|
| | | 0.15% Detergent Composition Concentration | | | | 0.5% Detergent Composition Concentration | |
| | | No Mini-Basket | | Mini-Basket | | Mini-Basket | |
| Stains | Fabrics | Expt'l. | Control | Expt'l. | Control | Expt'l. | Control |
| Coffee/Tea | Cotton | 30 | −3 | 39 | 4 | 53 | 5 |
| Red Wine (EMPA 114) | Cotton | 20 | 12 | 16 | 8 | 22 | 7 |
| Sulfo Dye (EMPA 115) | Cotton | 7 | 0 | 11 | 1 | 22 | 1 |
| Tea | Cotton | 25 | 8 | 35 | 9 | 55 | 17 |
| Tea | Cotton/Dacron | −4 | −8 | 0 | −9 | 8 | −6 |
| Coffee | Cotton | 32 | 17 | 47 | 19 | 56 | 25 |
| Coffee | Cotton/Dacron | 27 | 18 | 42 | 24 | 55 | 40 |
| Blueberry | Cotton | 43 | 32 | 53 | 32 | 63 | 41 |
| Blueberry | Cotton/Dacron | 21 | 14 | 28 | 18 | 38 | 22 |
| Cocoa | Cotton | 29 | 33 | 36 | 29 | 36 | 31 |
| Cocoa | Cotton/Dacron | 13 | 15 | 22 | 21 | 27 | 15 |
| Grape | Cotton | 54 | 44 | 63 | 44 | 70 | 53 |
| Grape | Cotton/Dacron | 24 | 20 | 33 | 23 | 41 | 27 |

With respect to the various dyed swatches described, ΔRd and Δb readings are taken as a measure of changes, if any, in color (Table IV).

TABLE IV

| | | Color Safety (Δb and ΔRd) 0.15% Detergent Composition Conc. (24° C.) | | | | | | | | 0.5% Detergent Composition Conc. (24° C.) | | | |
|---|---|---|---|---|---|---|---|---|---|---|---|---|---|
| | | No Mini-Basket | | | | Mini-Basket | | | | Mini-Basket | | | |
| | | Expt'l. | | Control | | Expt'l. | | Control | | Expt'l. | | Control | |
| Colors | Fabrics | Δb; | ΔRd | Δb; | ΔRd | Δb; | ΔRd | Δb; | ΔRd | Δb; | ΔRd | Δb; | ΔRd |
| Blue (Wamsutta) | Cotton | −0.7; | 0.3 | −1.0; | 0.1 | −1.2; | 0.3 | −1.1; | 0.1 | −1.1; | 0.2 | −0.9; | 0.1 |
| Blue (Cannon) | Cotton/Dacron | 0.4; | 1.1 | 0.3; | 1.0 | 0.2; | 1.2 | 0.2; | 1.1 | 0.3; | 1.2 | 0.3; | 1.4 |
| Pink (Commercial) | Cotton | 0.3; | 0.3 | −0.1; | 0.6 | −0.4; | 0.8 | −0.4; | 0.9 | −0.2; | 1.0 | −0.4; | 0.8 |

TABLE IV-continued

| | | Color Safety (Δb and ΔRd) 0.15% Detergent Composition Conc. (24° C.) | | | | | | | | 0.5% Detergent Composition Conc. (24° C.) | | | |
|---|---|---|---|---|---|---|---|---|---|---|---|---|---|
| | | No Mini-Basket | | | | Mini-Basket | | | | Mini-Basket | | | |
| | | Expt'l. | | Control | | Expt'l. | | Control | | Expt'l. | | Control | |
| Colors | Fabrics | Δb; | ΔRd | Δb; | ΔRd | Δb; | ΔRd | Δb; | ΔRd | Δb; | ΔRd | Δb; | ΔRd |
| Pink (Commercial) | Cotton/Dacron | 0.1; | 0.2 | 0.0; | 0.3 | 0.0; | 0.2 | 0.0; | 0.1 | 0.1; | 0.9 | −0.1; | 0.5 |
| Yellow (Commercial) | Cotton | 1.3; | 0.6 | 1.7; | 1.0 | 1.6; | 1.0 | 2.2; | 1.2 | 1.8; | 1.1 | 1.8; | 1.0 |
| Yellow (Commercial) | Cotton/Dacron | −0.4; | 0.3 | −0.7; | 0.6 | −0.9; | 0.3 | −0.6; | 0.8 | −0.9; | 1.0 | −0.3; | 0.9 |
| Green (Commercial) | Cotton/Dacron | 0.4; | 1.1 | 0.2; | 0.7 | 0.1; | 0.9 | 0.8; | 0.7 | 0.2; | 1.5 | 1.0; | 1.7 |
| Blue (Commercial) | Cotton/Dacron | 0.0; | 1.7 | −0.1; | 1.8 | −0.3; | 1.4 | −0.4; | 1.1 | −0.4; | 2.3 | −0.4; | 2.2 |

From the data of Tables III and IV it is seen that stain removals are improved by the presence of the present activator and the dyes are not bleached or changed objectionably, compared to the control without activator. In other tests the presence of activator is not harmful and is sometimes helpful for soil removal and retention of whiteness. The fluorescent intensity of the fabrics washed in activated perborate is improved by substitution of part or all of brightener 5BM with brightener BHC. The pH's of the wash solutions at the ends of the washings are in the range of 10.1 to 10.3 for the experimental and 10.2 to 10.4 for the control.

In the foregoing examples, instead of NASC and MBSC there have been substituted in at least some of the formulas given p-toluenesulfonyl chloride (TSC); o-nitrobenzenesulfonyl chloride (NBSC); p-chlorobenzenesulfonyl chloride (CBSC); benzenesulfonyl chloride (BSC); m-benzenedisulfonyl chloride (MBDSC); and m-(chlorosulfonyl)-benzoic acid (MCSBA) and good washing and bleaching have been obtained without objectionable harm to dyed cloths. Also, corresponding sulfonyl bromides are used interchangeably and lower alcohol esters of the acid are also substituted therefor with similar good results.

EXAMPLE 5

| | Percent |
|---|---|
| Sodium linear tridecylbenzene sulfonate | 9.0 |
| Ethoxylated (7 mols EtO) $C_{12-15}$ fatty alcohol | 4.0 |
| Pentasodium tripolyphosphate | 32.0 |
| Sodium silicate ($Na_2O:SiO_2$ = 1:2.4) | 7.0 |
| Sodium carboxymethyl cellulose | 0.5 |
| Fluorescent brightener (Phorwite BHC or equivalent) | 0.9 |
| Moisture | 11.0 |
| Sodium perborate tetrahydrate | 12.0 |
| NASC | 6.0 |
| Sodium sulfate, anhydrous | 17.6 |
| | 100.0 |

The above formulation is tested against a control in which the perborate and NASC are replaced with sodium sulfate, at 0.15% and 0.50% concentrations in wash waters of 100 p.p.m. ($CaCO_3$) hardness in automatic washing machines against the various stains described in Example 1 (with the test methods being those employed in Example 1). The experimental formulations show improved stain removals without undesirable spottings or over-bleachings of the washed and previously stained fabrics and they do not objectionably change the colors of normal dyed materials in the washes. Similar results are obtained when MBSC is substituted for the NASC, with slightly better stain removals.

EXAMPLE 6

| | Percent |
|---|---|
| Linear tridecylbenzene sulfonate, sodium salt | 12.9 |
| Heptaethoxylated $C_{12-15}$ fatty alcohol | 0.9 |
| Pentasodium tripolyphosphate | 27.5 |
| Sodium silicate ($Na_2O:SiO_2$ = 1:2.4) | 6.0 |
| Borax | 0.9 |
| Sodium carboxymethyl cellulose | 0.4 |
| Optical brighteners (mixture of Tinopals RBS and 5BM with Stilbene Brightener No. 4) | 0.6 |
| Moisture | 9.5 |
| Sodium perborate tetrahydrate | 10.0 |
| MBSC | 4.0 |
| Sodium sulfate, anhydrous | 27.3 |
| | 100.0 |

The above experimental formulation is made according to the method described in Example 1 and is tested against a control wherein the perborate and MBSC are replaced with the same weights of sodium sulfate, anhydrous, at 24°, 49° and 60° C., against coffee-tea, red wine and sulfo dye-stained cotton swatches, using 0.5% detergent composition concentrations and 15 minute washing periods. In all cases the ΔRd values are significantly greater (more positive) for the experimental compositions, indicating better stain removals.

When a Burlington Mills 50:50 cotton:polyester blue percale is tested there is no objectionable color change compared to the control, showing that the activator is not unnecessarily harsh in its joint effects with the peroxy compound. Similarly, the experimental composition does not undesirably change the whiteness of cotton, compared to the control.

Substantially the same results are obtained when instead of the perborate, percarbonate is employed and when half the phosphate is replaced by sodium carbonate, sodium silicate ($Na_2O:SiO_2$=1:2.4), NTA, potassium citrate, sodium gluconate or other suitable builder salt (inorganics are preferred). Such results are also obtained when the detergent mixture is replaced by similar proportions of linear sodium dodecylbenzene sulfonate, sodium paraffin sulfonate, sodium higher alpha-olefin sulfonate or sodium higher fatty acids monoglyceride sulfate. Also, uses of para-methoxybenzenesulfonyl bromide and o-stearyloxybenzenesulfonyl chloride produce similar results.

EXAMPLE 7

A commercial nonionic detergent-containing anionic detergent-based built synthetic organic detergent composition, in spray dried form, comprising 15% of sodium tridecylbenzenesulfonate, 7% of sodium silicate ($Na_2O:SiO_2$=1:2.4), 33% of pentasodium tripolyphosphate, 1% of polyethoxylated higher fatty alcohol ($C_{12-}$ higher fatty alcohol ethoxylated with about 11 mols of ethylene oxide per mol), 10% of water, 0.3% of sodium carboxymethyl cellulose and 33.7% of sodium sulfate, anhydrous, in spray dried particulate form, is mixed with sodium carbonate, sodium perborate tetrahydrate and sodium sulfate. The proportions utilized are about 75% of the detergent composition, 6% of sodium carbonate, 6% of activator, 4.5% or 9% of sodium perborate tetrahydrate and the remainder, sodium sulfate. The mixture is used at a concentration of 0.8% to wash a mixed load of test fabrics in a Terg-O-Tometer washing machine containing wash water having about 100 p.p.m. of hardness, expressed as calcium carbonate, and being at a temperature of about 49° C. After 15 minutes of agitation, with the Terg-O-Tometer operating at 100 r.p.m., at which time the pH of the wash water is about 9.4, the test fabrics are removed, rinsed and dried, after which they are evaluated for Rd and b changes. When the activator is MBSC and 9% of perborate is present the coffee-tea stained cotton test fabric ΔRd is 7.8, whereas at the 4.5% perborate concentration such figure is 6.9. The comparable figures for NASC are 6.4 and 5.2. With red wine (EMPA 114) stained test fabric the ΔRd's are 19.7; 15.6; 15.1; and 9.9, respectively, showing that the MBSC is a more efficient stain remover, especially at lower concentrations of perborate. With EMPA 115 stain the figures are 13.8; 9.4; 8.0; and 6.1. In a similar manner, the color change of a Blue 6 vat dyed cotton fabric is measured. The ΔRd's are 1.4; 1.5; 0.9 and 0.7, respectively, whereas Δb's are −0.8; −0.7; −0.7; and −0.6. This indicates that there is little change in the color of the dyed fabric swatches but that change is somewhat greater with MBSC than with NASC. Whiteness retention of white fabric washed in the same wash water as the test swatches and the blue dyed fabric is about the same with MBSC and NASC, being −0.2; 0.0; −0.2; and −0.2 for the ΔRd's and −0.5; −0.6; −1.0; and −0.9, for the Δb's, in the order previously given.

EXAMPLE 8

| | Parts |
|---|---|
| Sodium linear tridecylbenzene sulfonate | 7.6 |
| Sodium coco-tallowate (soap, including 85% sodium tallowate and 15% sodium cocate) | 1.9 |
| Nonionic Detergent (condensation product of $C_{14-15}$ fatty alcohol and 11 mols of ethylene oxide per mol) | 2.0 |
| Nonionic detergent (condensation product of $C_{16-20}$ fatty alcohol and 80 mols ethylene oxide per mol) | 0.4 |
| Nonionic detergent (condensation product of $C_{10-12}$ fatty alcohol and 5 mols ethylene oxide per mol) | 0.5 |
| Sodium tripolyphosphate | 56.8 |
| Sodium silicate ($Na_2O:SiO_2$ = 1:2.4) | 4.7 |
| Sodium hydroxide | 0.9 |
| Fluorescent brightener | 0.2 |
| Sodium carbonate | 6.0 |
| Sodium sulfate | 2.0 |
| Sodium perborate tetrahydrate | 11.0 |
| MBSC | 6.0 |
| | 100.0 |

A mixed load of test fabrics is washed in separate experiments at temperatures of 32°, 49° and 60° C. in Piscataway, N.J. tap water of about 100 p.p.m. (as calcium carbonate) hardness in a Terg-O-Tometer operating at 100 r.p.m. for 15 minutes, after which the test fabrics are rinsed and drid and reflectances thereof are measured with a Gardner Color Difference Meter, from which readings stain removal, color safety and whiteness retention characteristics are calculated (ΔRd and Δb). The pH of the washing solution is in the range of 9.5 to 9.9.

Using coffee/tea stained fabrics ΔRd at 32° C. is 6.8, at 49° C. is 8.7 and at 60° C. is 8.5. Such ΔRd's are 5.9, 6.3 and 6.1 when NASC is substituted for MBSC, showing that the MBSC does a better job of stain removal. When red wine-stained cloths (EMPA 114) are used the figures are 14.7, 21.1 and 23.7 for MBSC and 12.5, 17.2 and 20.7 for NASC, showing a similar superiority for MBSC. For sulfo black dyed cloths (EMPA 115) the ΔRd's are 9.9, 13.9 and 13.9 for MBSC and 9.7, 9.6 and 8.9 for NASC, respectively, showing similar better stain removal for the MBSC-activated bleach.

To test color removal a commercial French blue dyed cotton fabric is treated in the same manner and ΔRd and Δb are calculated. The results are about the same for both MBSC and NASC, 0.1, 0.5 and 0.7 for ΔRd for MBSC at 32°, 49° and 60° C., respectively, and 0.1, 0.2 and 0.5 for corresponding readings of such cloths subjected to NASC bleaching. Corresponding Δb's are −0.7, −1.1 and −1.3 for MBSC and −0.7, −0.9 and −1.1 for NASC. Whiteness retention characteristics of a non-stained fabric washed in the same wash water as the other test fabrics indicate about an equal pick-up of blue dye by the test fabrics because whereas the ΔRd readings are 0.6, 0.1 and 0.1 for MBSC and 0.2, −0.2 and −0.5 for NASC, the corresponding Δb readings are −5.3, −4.8 and −3.9 for MBSC and −4.8, −4.8 and −4.0 for NASC.

It may be concluded as a result of these tests that both MBSC and NASC activated perborate sufficiently to result in good stain removal by the bleaching detergent compositions and no damage to the color of a dyed test fabric. Similarly, clean fabrics washed with dyed fabrics are not yellowed (in fact, are slightly blued).

The invention has been described with respect to various illustrations and embodiments thereof but is not to be limited to these because it is evident that one of skill in the art with the present specification before him will be able to utilize substitutes and equivalents without departing from the invention.

What is claimed is:

1. A process for the low temperature bleaching of stained and/or soiled fabrics which comprises treating them with an aqueous peroxygen bleaching solution having a pH of about 6 to about 12 and containing as a peroxygen activator therefor, an effective amount of an aromatic sulfonyl fluoride of the formula $ArSO_2F$ wherein Ar is an aromatic ring system selected from the class consisting of a phenyl group, a naphthyl group, and a heterocyclic group having 5 to 6 members of which 1 to 2 are heteratoms selected from the class consisting of nitrogen, oxygen and sulfur, said groups optionally bearing substituents selected from the class consisting of nitro, carboxyl, hydroxy, sulfo alkyl of 1 to 16 carbon atoms, alkoxy of 1 to 16 carbon atoms, aliphatic carboxamido of 1 to 16 carbon atoms, aliphatic acyl of 1 to 16 carbon atoms, chlorine and bromine.

2. The process according to claim 1 wherein the mole ratio of peroxygen to activator is from about 60:1 to about 1:3.

3. The process according to claim 2 wherein the peroxygen is sodium perborate tetrahydrate.

4. The process according to claim 2 wherein the quantity of peroxygen is sufficient to provide from about 2 ppm to about 400 ppm of active oxygen.

5. The process according to claim 1 wherein the bleach solution contains a detergent agent.

6. The process according to claim 1 wherein the pH of the bleach solution is maintained by means of a buffering agent.

7. A bleaching composition consisting essentially of a peroxygen bleaching compound and as a peroxygen activator, an aromatic sulfonyl fluoride having the formula $ArSO_2F$ wherein Ar is an aromatic ring system selected from the class consisting of a phenyl group, a naphthyl group, and a heterocyclic group having 5 to 6 members of which 1 to 2 are heteroatoms selected from the class consisting of nitrogen, oxygen and sulfur, said groups optionally bearing substituents selected from the class consisting of nitro, alkyl of 1 to 16 carbon atoms, alkoxy of 1 to 16 carbon atoms, aliphatic carboxamido of 1 to 16 carbon atoms, aliphatic acyl of 1 to 16 carbon atoms, chlorine and bromine.

8. A bleaching composition consisting essentially of a peroxygen bleaching compound and as a peroxygen activator, an aromatic sulfonyl fluoride of the formula $ArSO_2F$ wherein Ar is phenyl or naphthyl bearing 1 to 3 substituents selected from the class consisting of nitro, lower alkyl, lower aliphatic carboxamido, chlorine, bromine, lower aliphatic acyl and lower alkoxyl.

9. The composition according to claim 7 wherein the peroxygen compound is sodium perborate tetrahydrate.

10. A detergent composition consisting essentially of a detergent agent and the composition defined in claim 7.

11. A bleaching composition consisting essentially of a peroxygen bleaching compound, an aromatic sulfonyl fluoride having the formula $ArSO_2F$ wherein Ar is an aromatic ring system selected from the class consisting of a phenyl group, a naphthyl group, and a heterocyclic group having 5 to 6 members of which 1 to 2 are heteroatoms selected from the class consisting of nitrogen, oxygen and sulfur, said groups optionally bearing substituents selected from the class consisting of nitro, alkyl of 1 to 16 carbon atoms, alkoxy of 1 to 16 carbon atoms, aliphatic carboxamido of 1 to 16 carbon atoms, aliphatic acyl of 1 to 16 carbon atoms, chlorine and bromine and sufficient buffering agent to maintain a pH of about 6 to 12 when the bleaching composition is dissolved in water.

12. The detergent composition of claim 10 wherein the mole ratio of peroxygen to activator is from about 6:1 to about 1:5.

13. A detergent composition consisting essentially of (a) from about 4% to about 60% by weight of the bleaching composition of claim 11, (b) from about 5% to about 40% by weight of a detergent agent; and (c) from about 10% to about 60% by weight of a detergent builder.

14. The detergent composition of claim 12 wherein the peroxygen compound is sodium perborate tetrahydrate and the activator of claim 8.

* * * * *